US010337435B2

(12) United States Patent
Sakashita

(10) Patent No.: US 10,337,435 B2
(45) Date of Patent: Jul. 2, 2019

(54) HEATER CONTROL DEVICE FOR EXHAUST GAS SENSOR

(71) Applicant: DENSO CORPORATION, Kariya, Aichi-pref. (JP)

(72) Inventor: Yoshihiro Sakashita, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/308,929

(22) PCT Filed: Apr. 13, 2015

(86) PCT No.: PCT/JP2015/002055
§ 371 (c)(1),
(2) Date: Nov. 4, 2016

(87) PCT Pub. No.: WO2015/170447
PCT Pub. Date: Nov. 12, 2015

(65) Prior Publication Data

US 2017/0074147 A1 Mar. 16, 2017

(30) Foreign Application Priority Data

May 7, 2014 (JP) ..... 2014-095791

(51) Int. Cl.
*F01N 11/00* (2006.01)
*F02D 41/14* (2006.01)
*F02D 41/22* (2006.01)

(52) U.S. Cl.
CPC ..... *F02D 41/1494* (2013.01); *F01N 11/002* (2013.01); *F01N 2560/06* (2013.01); (Continued)

(58) Field of Classification Search
CPC ..... F02D 41/068; F02D 41/1494; F02D 41/1495; F01N 2560/20; F01N 2240/16
See application file for complete search history.

(56) References Cited

U.S. PATENT DOCUMENTS 6,304,813 B1 * 10/2001 Ikeda ..... F02D 41/1494 123/697
6,812,436 B2 * 11/2004 Nomura ..... G01N 27/4067 219/202

(Continued)

FOREIGN PATENT DOCUMENTS

| | | |
|---|---|---|
| JP | 2007-120390 | 5/2007 |
| JP | 2009-281867 | 12/2009 |
| JP | 2010-032275 | 2/2010 |

*Primary Examiner* — Sizo B Vilakazi
*Assistant Examiner* — Kevin R Steckbauer
(74) *Attorney, Agent, or Firm* — Nixon & Vanderhye P.C.

(57) ABSTRACT

A preheating control for controlling an energization of a heater is executed so that a sensor element of an exhaust gas sensor is preheated within a temperature range in which no element crack caused by water occurs until a predetermined preheating period elapses after an engine starts. In performing the preheating control, first, an energization duty of the heater is set to a preheating promotion energization duty to promptly raise a temperature of the sensor element until it is determined that the temperature of the sensor element reaches a predetermined upper limit temperature. After it is determined that the temperature of the sensor element reaches the upper limit temperature, the energization duty of the heater is set so that the temperature of the sensor element is maintained at the upper limit temperature to sufficiently raise the temperature of the overall sensor element during the preheating control.

6 Claims, 3 Drawing Sheets

(52) U.S. Cl.
CPC ..... *F01N 2560/20* (2013.01); *F02D 41/1495* (2013.01); *F02D 41/222* (2013.01)

(56) References Cited

U.S. PATENT DOCUMENTS

| | | | | |
|---|---|---|---|---|
| 6,935,101 | B2 * | 8/2005 | Morinaga | G01N 27/4067 123/685 |
| 8,362,405 | B2 * | 1/2013 | Hasegawa | H05B 1/0236 123/676 |
| 9,212,971 | B2 * | 12/2015 | Oesselke | G01M 15/104 |
| 2004/0026408 | A1 * | 2/2004 | Morinaga | G01N 27/4067 219/497 |
| 2004/0047396 | A1 * | 3/2004 | Nomura | F02D 41/1476 374/141 |
| 2005/0205550 | A1 | 9/2005 | Saito et al. | |
| 2009/0184105 | A1 * | 7/2009 | Hasegawa | H05B 1/0236 219/497 |
| 2014/0047912 | A1 * | 2/2014 | Oesselke | G01M 15/104 73/114.73 |
| 2016/0223488 | A1 * | 8/2016 | Kayama | G01N 27/4175 |
| 2017/0009685 | A1 * | 1/2017 | Sakashita | F02D 41/064 |
| 2017/0010236 | A1 * | 1/2017 | Sakashita | F01N 11/002 |
| 2017/0321588 | A1 * | 11/2017 | Aoki | F01N 11/007 |

* cited by examiner

HEATER CONTROL DEVICE FOR EXHAUST GAS SENSOR

CROSS REFERENCE TO RELATED APPLICATION

This application is the U.S. national phase of International Application No. PCT/JP2015/002055 filed Apr. 13, 2015 which designated the U.S. and claims priority to Japanese Patent Application No. 2014-95791 filed on May 7, 2014, the entire contents of each of which are incorporated herein by reference.

TECHNICAL FIELD

The present disclosure is the invention related to a heater control device for an exhaust gas sensor which controls energization of a heater for heating a sensor element of the exhaust gas sensor to control a temperature of the sensor element.

BACKGROUND ART

In an internal combustion engine electronically controlled, an exhaust gas sensor (air-fuel ratio sensor or oxygen sensor) for detecting an air-fuel ratio or rich/lean of an exhaust gas is installed in an exhaust pipe, and a fuel injection amount is subjected to a feedback control so that the air-fuel ratio of the exhaust gas matches a target air-fuel ratio on the basis of an output of the exhaust gas sensor. In general, because the exhaust gas sensor is low in detection precision unless a temperature of a sensor element is raised up to an active temperature, the sensor element is heated by a heater incorporated in the exhaust gas sensor to promote the activation of the exhaust gas sensor after the internal combustion engine starts.

However, a water vapor produced by a combustion reaction of fuel and air is included in the exhaust gas of the internal combustion engine. When a temperature of the exhaust pipe is low immediately after the internal combustion engine starts, because the exhaust gas including the water vapor is cooled in the exhaust pipe, the water vapor in the exhaust gas may be condensed in the exhaust pipe, and a condensed water may be generated. For that reason, the condensed water generated in the exhaust pipe is likely to be attached to the sensor element of the exhaust gas sensor immediately after the internal combustion engine starts. When the sensor element is intensely heated by the heater immediately after the internal combustion engine starts, an "element crack" that the sensor element heated to a high temperature is cracked by local cooling (thermal strain) caused by adhesion of the condensed water may occur.

In a heater control device disclosed in Patent Literature 1 (JP-A-2007-120390), a preheating control for setting an energization duty of the heater so as to preheat the sensor element of the exhaust gas sensor at a temperature causing no element crack attributable to water is executed until a predetermined preheating period elapses from a start of the internal combustion engine. Thereafter, after the preheating period has elapsed, the energization duty of the heater is increased to raise the temperature of the sensor element up to the active temperature.

However, in the heater control device disclosed in Patent Literature 1, the energization duty of the heater is maintained at a constant value in performing the preheating control. When the energization duty of the heater is set to be larger, the temperature of the sensor element in the exhaust gas sensor is likely to exceed an element crack prevention temperature upper limit value (an upper limit value of a temperature which can prevent the element crack attributable to the water) during the preheating control. In order to prevent this situation, there is a need to set the energization duty of the heater to be smaller. For that reason, the temperature of the overall sensor element is likely to be insufficiently raised during the preheating control, and a time required until the temperature of the sensor element is raised to the active temperature is lengthened after the completion of the preheating control, resulting in a possibility that the sensor element cannot be activated precociously.

PRIOR ART LITERATURES

Patent Literature

[Patent Literature 1] JP 2007-120390 A

SUMMARY OF INVENTION

It is an object of the present disclosure to provide a heater control device for an exhaust gas sensor which is capable of activating a sensor element precociously while preventing an element crack of the exhaust gas sensor.

According to an aspect of the present disclosure, a heater control device for an exhaust gas sensor, includes: a heater that heats a sensor element of an exhaust gas sensor disposed in an exhaust gas passage of an internal combustion engine; and a heater energization control portion that executes a preheating control for controlling an energization of the heater to preheat the sensor element within a temperature range causing no element crack attributable to water, in which the heater energization control portion sets an energization control value of the heater to a preheating promotion energization control value which is larger than an energization control value after it is determined that a temperature of the sensor element reaches a predetermined upper limit temperature until it is determined that the temperature of the sensor element reaches the upper limit temperature, in performing the preheating control, and sets the energization control value of the heater to maintain the temperature of the sensor element at the upper limit temperature after it is determined that the temperature of the sensor element reaches the upper limit temperature.

In performing the preheating control, the energization control value of the heater is set to the preheating promotion energization control value of the heater until it is determined that the temperature of the sensor element reaches the predetermined upper limit temperature (element crack prevention temperature). As a result, the temperature of the sensor element can be promptly raised up to the upper limit temperature.

After it is determined that the temperature of the sensor element reaches the upper limit temperature, the energization control value of the heater is set to maintain the temperature of the sensor element at the upper limit temperature. As a result, the overall sensor element can be put into a state where the temperature of the sensor element is sufficiently raised during the preheating control.

With the above configuration, a time until the temperature of the sensor element is raised to the active temperature after the completion of the preheating control can be reduced, and the sensor element can be promptly activated while preventing the element crack of the exhaust gas sensor.

EMBODIMENTS FOR CARRYING OUT INVENTION

Figure 1:
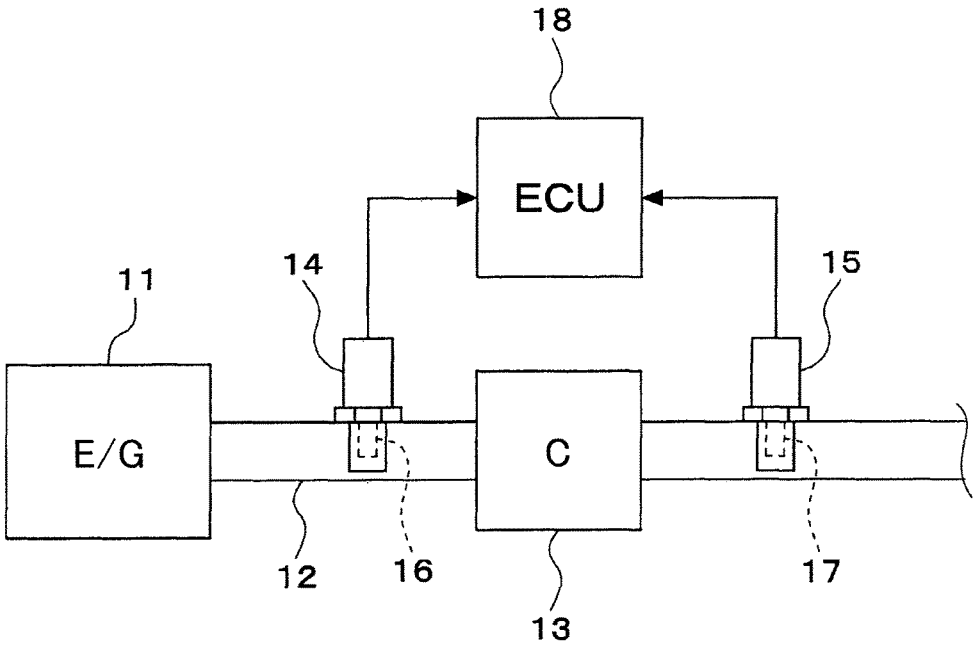
FIG. 1 is a diagram illustrating a schematic configuration of an engine control system according to an embodiment of the present disclosure.

A schematic configuration of an engine control system will be described with reference to FIG. 1.

A catalyst 13 such as a three-way catalyst for purifying CO, HC, and NOx in an exhaust gas is provided in an exhaust pipe 12 (exhaust gas passage) of an engine 11. Exhaust gas sensors 14 and 15 (air-fuel ratio sensor or oxygen sensor) for detecting an air-fuel ratio of the exhaust gas are provided upstream and downstream of the catalyst 13, respectively. Heaters 16 and 17 for heating sensor elements (not illustrated) are integrated in the respective exhaust gas sensors 14 and 15.

Outputs of the various sensors described above are input to an electronic control unit (ECU) 18. The ECU 18 mainly includes a microcomputer, and executes various engine control programs stored in a built-in ROM to control a fuel injection amount, an ignition timing, and a throttle position (intake air amount) according to an engine operating state.

In this situation, the ECU 18 performs a main feedback control for subjecting the fuel injection amount to a feedback correction so that the air-fuel ratio of the exhaust gas upstream of the catalyst 13 matches the target air-fuel ratio, on the basis of the output of the upstream exhaust gas sensor 14. Further, the ECU 18 performs a sub-feedback control for correcting the target air-fuel ratio or a feedback correction amount of the main feedback control on the basis of the output of the downstream exhaust gas sensor 15. The ECU 18 enhances an exhaust gas purifying efficiency of the catalyst 13 through the air-fuel ratio feedback control (main feedback control and sub-feedback control).

The exhaust gas sensors 14 and 15 are low in detection precision unless the respective temperatures of the sensor elements are raised up to an active temperature. Therefore, there is a need to energize the respective heaters 16 and 17 of the exhaust gas sensors 14 and 15 to heat the sensor elements for activation before starting the air-fuel ratio feedback control after the engine 11 starts. Therefore, in order to promptly start the air-fuel ratio feedback control after the engine 11 starts, there is a need to promptly activate the respective sensor elements of the exhaust gas sensors 14 and 15.

However, a water vapor produced by a combustion reaction of fuel and air is included in the exhaust gas of the engine 11. When the temperature of the exhaust pipe 12 is low immediately after the engine 11 starts, because the exhaust gas including the water vapor is cooled in the exhaust pipe 12, the water vapor in the exhaust gas may be condensed in the exhaust pipe 12, and a condensed water may be generated. For that reason, the condensed water generated in the exhaust pipe 12 is likely to be attached to the respective sensor elements of the exhaust gas sensors 14 and 15 immediately after the engine 11 starts. When the sensor elements are intensely heated by the heaters 16 and 17 immediately after the engine 11 starts, an "element crack" that the sensor elements heated to a high temperature are cracked by local cooling (thermal strain) caused by adhesion of the condensed water may occur.

The ECU 18 executes a heater energization control routine in FIG. 3 to be described later to execute a preheating control for controlling the energization of the heater 16 so as to preheat the sensor element of the exhaust gas sensor 14 within a temperature range causing no element crack attributable to water until a predetermined preheating period elapses after the engine 11 starts. Thereafter, after the preheating period has elapsed, the energization duty (energization control value) of the heater 16 is increased to raise the temperature of the sensor element up to the active temperature.

Figure 2:
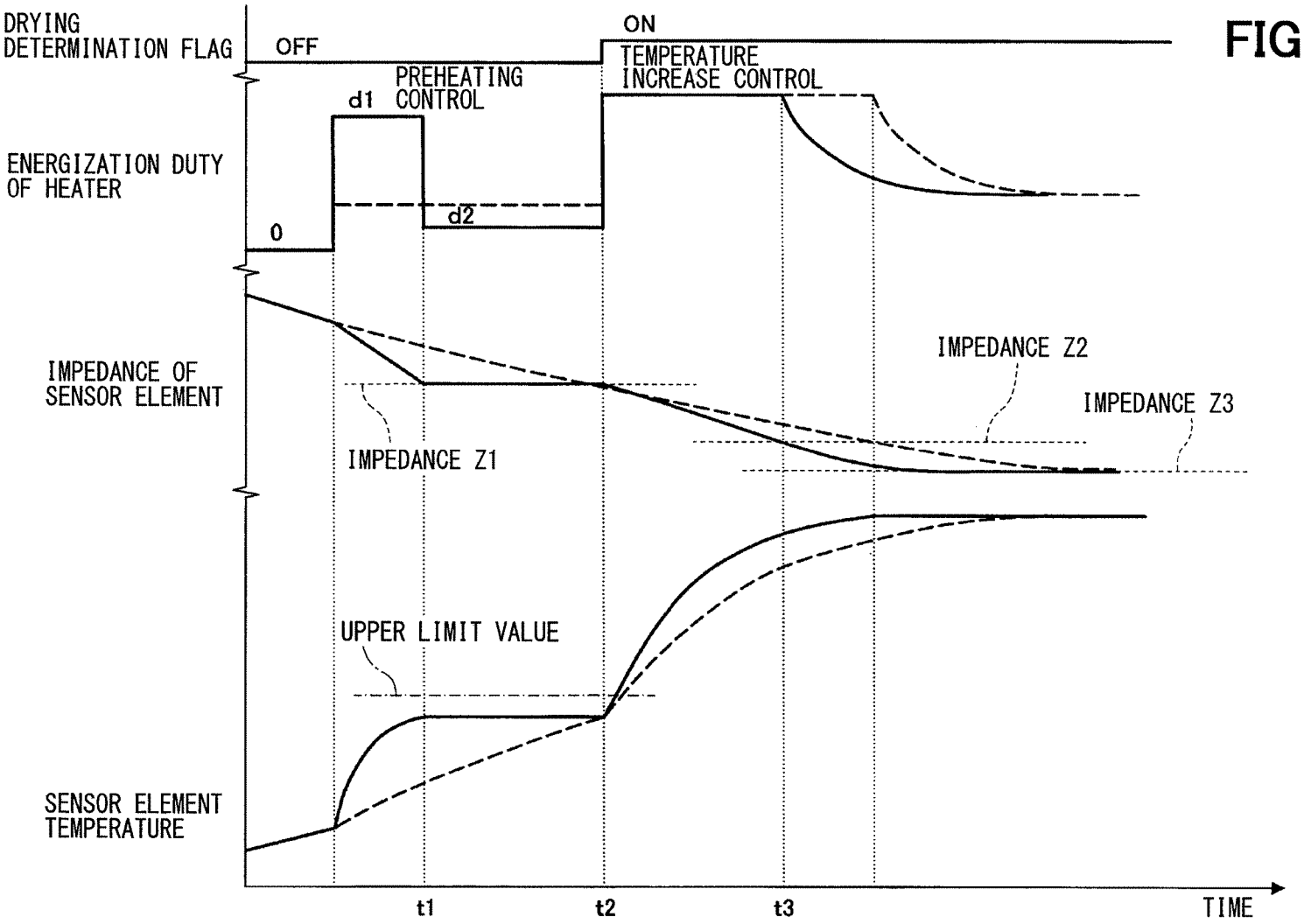
FIG. 2 is a timing chart illustrating an execution example of a heater energization control.

However, as indicated by a broken line in FIG. 2, when the energization duty of the heater 16 is set to be larger, the temperature of the sensor element of the exhaust gas sensor 14 is likely to exceed an element crack prevention temperature upper limit value during the preheating control. In order to prevent this situation, there is a need to set the energization duty of the heater 16 to be smaller. For that reason, the temperature of the overall sensor element is likely to be insufficiently raised during the preheating control, and a time required until the temperature of the sensor element is raised to the active temperature is lengthened after the completion of the preheating control, resulting in a possibility that the sensor element cannot be activated precociously.

In the present disclosure, as indicated by a solid line in FIG. 2, in performing the preheating control, first, the energization duty of the heater 16 is set to a preheating promotion energization duty until it is determined that the temperature of the sensor element in the exhaust gas sensor 14 reaches a predetermined upper limit temperature. The preheating promotion energization duty is set to a value larger than the energization duty after it is determined that the temperature of the sensor element reaches the upper limit temperature. After it is determined that the temperature of the sensor element reaches the upper limit temperature, the energization duty of the heater 16 is set so as to maintain the temperature of the sensor element at the upper limit temperature.

Specifically, it is determined whether the inside of the exhaust pipe 12 is in a drying state, or not, after the engine 11 starts. When it is determined that the inside of the exhaust pipe 12 is not in the dry state (an exhaust pipe drying determination flag is off), a moisture is likely to adhere to the exhaust pipe 12 or the exhaust gas sensor 14. Therefore, the preheating control for controlling the energization of the heater 16 is executed so as to preheat the sensor element of the exhaust gas sensor 14 within a temperature range causing not element crack attributable to water.

In the preheating control, the energization duty of the heater 16 is set to a preheating promotion energization duty d1. The preheating promotion energization duty d1 is set to a value larger than the energization duty (for example, temperature maintaining energization duty d2) after it is determined that the temperature of the sensor element reaches the upper limit temperature. As a result, the temperature of the sensor element is promptly raised up to the upper limit temperature.

It is determined whether the temperature of the sensor element reaches the upper limit temperature, or not, according to whether an impedance Z of the sensor element becomes smaller than an upper limit temperature determination impedance Z1 (a value corresponding to the upper limit temperature), or not.

Therefore, the energization duty of the heater 16 is set so as to maintain the temperature of the sensor element at the upper limit temperature at a time t1 when the impedance Z of the sensor element becomes smaller than the upper limit temperature determination impedance Z1, and it is determined that the temperature of the sensor element reaches the upper limit temperature. For example, the energization duty of the heater 16 is set to the temperature maintaining energization duty d2. As a result, the overall sensor element is put into a state where the temperature of the sensor element is sufficiently raised during the preheating control.

Thereafter, at a time t2 when it is determined that the inside of the exhaust pipe 12 is in the drying state (the exhaust pipe drying determination flag is on), it is determined that the preheating period has elapsed, and a temperature increase control for controlling the energization of the heater 16 is executed so as to promptly raise the temperature of the sensor element. In the temperature increase control, the energization duty of the heater 16 is set to the temperature increase energization duty (for example, 100%) to heat the sensor element.

It is determined whether the sensor element is activated, or not, according to whether the impedance Z of the sensor element becomes smaller than an activation determination impedance Z2 (a value corresponding to the active temperature of the sensor element), or not.

Thereafter, an impedance control for controlling the energization of the heater 16 is executed so as to maintain the sensor element in an active state at a time t3 when the impedance Z of the sensor element becomes smaller than the activation determination impedance Z2, and it is determined that the sensor element has been activated. In the impedance control, the energization duty of the heater 16 is subjected to the feedback control so as to match the impedance Z of the sensor element with a target impedance Z3.

Hereinafter, processing contents of the heater energization control routine in FIG. 3 which are executed by the ECU 18 will be described.

Figure 3:
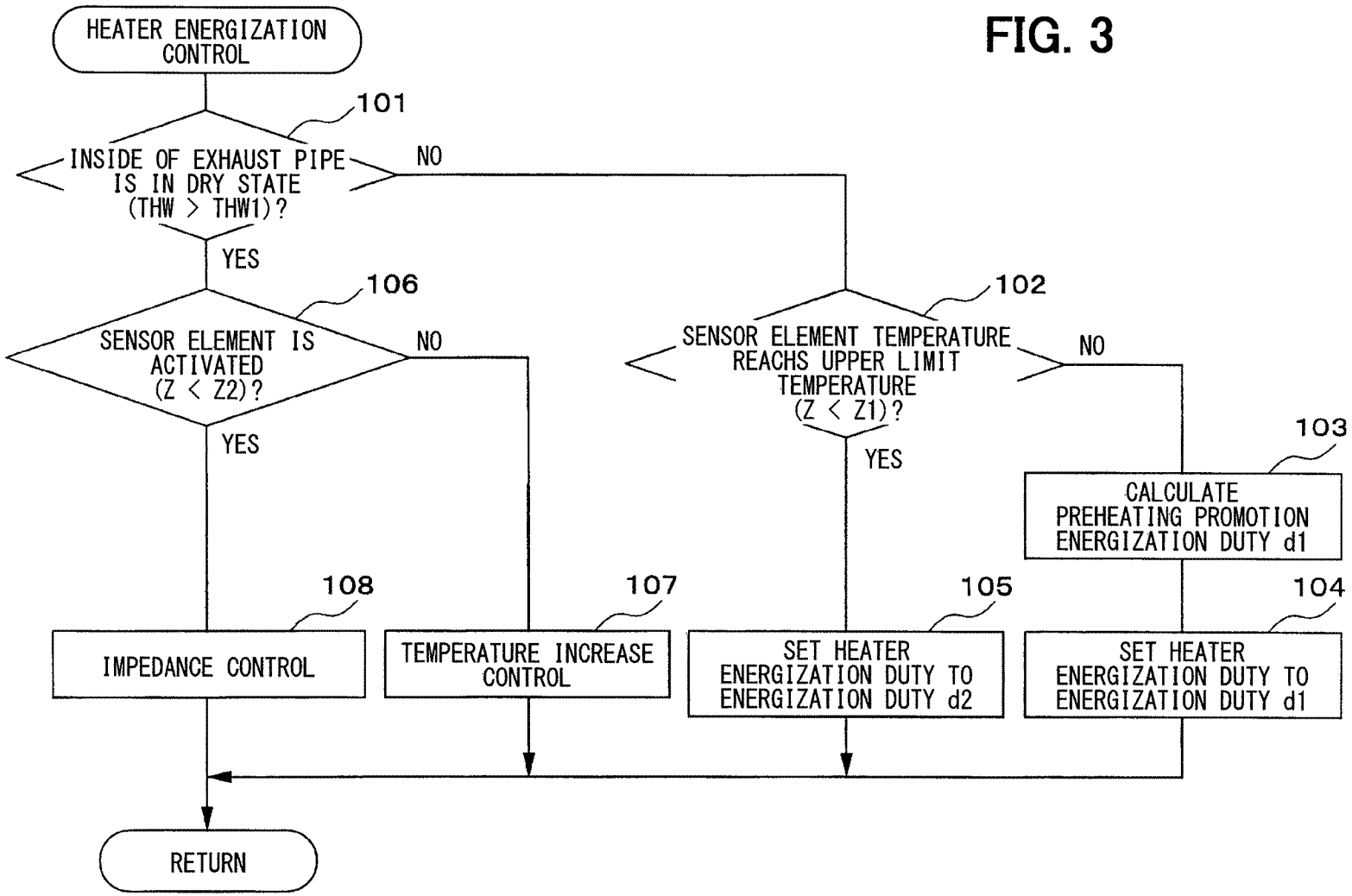
FIG. 3 is a flowchart illustrating a flow of processing of a heater energization control routine.

The heater energization control routine illustrated in FIG. 3 is repetitively executed in a predetermined cycle in a power-on period of the ECU 18, which corresponds to the heater energization control device.

In Step 101, it is determined whether the inside of the exhaust pipe 12 is in the drying state (a state in which a moisture in the exhaust pipe 12 is evaporated), or not, for example, according to whether a coolant temperature Thw is higher than a predetermined value Thw1, or not.

In Step 101, when it is determined that the inside of the exhaust pipe 12 is not in the drying state (Thw≤Thw1), it is determined that the moisture is likely to adhere to the exhaust pipe 12 or the exhaust gas sensor 14, and the preheating control (processing in Steps 102 to 105) is executed as follows.

In Step 102, it is determined whether the temperature of the sensor element in the exhaust gas sensor 14 reaches the upper limit temperature, or not, according to whether the impedance Z of the sensor element becomes smaller than the upper limit temperature determination impedance Z1, or not. The upper limit temperature determination impedance Z1 is set to a value corresponding to the upper limit temperature.

When it is determined in Step 102 that the temperature of the sensor element does not reach the upper limit temperature (Z≥Z1), the process proceeds to Step 103, and the preheating promotion energization duty d1 is calculated. The preheating promotion energization duty d1 is set to a value larger than the energization duty d2 after it is determined that the temperature of the sensor element reaches the upper limit temperature.

When the energization duty of the heater 16 is set to the preheating promotion energization duty d1 to promptly raise the temperature of the sensor element, if the temperature of the sensor element is too soared, the sensor element is likely to be damaged. For that reason, it is preferable to raise the temperature of the sensor element at a moderate speed.

Under the circumstances, in the present embodiment, the preheating promotion energization duty d1 is calculated by a map or a formula according to the operating condition of the engine 11 and the environmental condition. In this example, the operating condition includes, for example, at least one of the coolant temperature, the exhaust gas temperature, a rotational speed, and a load. The environmental condition includes, for example, an outside air temperature. The map or the formula of the preheating promotion energization duty d1 is created on the basis of test data or design data in advance, and stored in the ROM of the ECU 18.

The energization duty for raising the temperature of the sensor element at the moderate speed is changed according to the operating condition of the engine 11 and the environmental condition. The preheating promotion energization duty d1 is changed, and the preheating promotion energization duty d1 is set to an appropriate value (the energization duty for raising the temperature of the sensor element at the moderate speed).

Thereafter, the process proceeds to Step 104, the energization duty of the heater 16 is set to the preheating promotion energization duty d1 to promptly raise the temperature of the sensor element.

Thereafter, in the above Step 102, when it is determined that the temperature of the sensor element reaches the upper limit temperature (Z<Z1), the process proceeds to Step 105, and the energization duty of the heater 16 is set to the temperature maintaining energization duty d2 to maintain the temperature of the sensor element at about the upper limit temperature. Alternatively, the energization duty of the heater 16 may be subjected to the feedback control so as to match the impedance Z of the sensor element with the upper limit temperature determination impedance Z1.

Thereafter, in the above Step 101, when it is determined that the inside of the exhaust pipe 12 is in the drying state (Thw>Thw1), it is determined that the preheating period has elapsed, and the process proceeds to Step 106. It is determined whether the sensor element is activated, or not, according to whether the impedance Z of the sensor element becomes smaller than the activation determination impedance Z2, or not. The activation determination impedance Z2 is set to a value corresponding to the active temperature of the sensor element.

In Step 106, when it is determined that the sensor element is not activated (Z≥Z2), the process proceeds to Step 107, and the temperature increase control is executed. In the temperature increase control, the energization duty of the heater 16 is set to the temperature increase energization duty (for example, 100%) to heat the sensor element.

Thereafter, in the above Step 106, when it is determined that the sensor element is activated (Z<Z2), the process proceeds to Step 108 to execute the impedance control. In the impedance control, the energization duty of the heater 16 is subjected to the feedback control so as to match the impedance Z of the sensor element with the target impedance Z3. Specifically, the energization duty of the heater 16 is calculated under a PI control so as to reduce a deviation between the impedance Z of the sensor element and the target impedance Z3.

In the present embodiment described above, in performing the preheating control, first, the energization duty of the heater 16 is set to a preheating promotion energization duty until it is determined that the temperature of the sensor element in the exhaust gas sensor 14 reaches a predetermined upper limit temperature. As a result, the temperature of the sensor element can be promptly raised up to the upper limit temperature. After it is determined that the temperature of the sensor element reaches the upper limit temperature, the energization duty of the heater 16 is set so as to maintain the temperature of the sensor element at the upper limit temperature. As a result, the overall sensor element can be put into a state where the temperature of the sensor element is sufficiently raised during the preheating control. With the above configuration, a time until the temperature of the sensor element is raised to the active temperature after the completion of the preheating control can be reduced, and the sensor element can be promptly activated while preventing the element crack of the exhaust gas sensor 14.

In the present embodiment, the preheating promotion energization duty is calculated according to the operating condition of the engine 11 and the environmental condition. With the above configuration, the preheating promotion energization duty can be changed to set the preheating promotion energization duty to the appropriate value according to the operating condition of the engine 11 and the environmental condition.

Further, in the present embodiment, it is determined whether the temperature of the sensor element reaches the upper limit temperature, or not, according to whether the impedance of the sensor element becomes smaller than an upper limit temperature determination impedance, or not. Because the impedance of the sensor element is changed according to the temperature of the sensor element, when the impedance of the sensor element is monitored, it can be determined with high precision whether the temperature of the sensor element reaches the upper limit temperature, or not.

In the above embodiment, the preheating promotion energization duty is calculated according to both of the operating condition of the engine 11 and the environmental condition. However, without being limited to this configuration, the preheating promotion energization duty may be calculated according to only one of the operating condition of the engine 11 and the environmental condition. Alternatively, the preheating promotion energization duty may be set to a predetermined fixed value.

In the above embodiment, it is determined whether the temperature of the sensor element reaches the upper limit temperature, or not, on the basis of the impedance of the sensor element. However, without being limited to this configuration, it may be determined whether the temperature of the sensor element reaches the upper limit temperature, or not, on the basis of a resistance of the heater 16 or an integral power consumption of the heater 16. Alternatively, it may be determined whether the temperature of the sensor element reaches the upper limit temperature, or not, on the basis of two or three of the impedance of the sensor element, the resistance of the heater 16, and the integral power consumption of the heater 16. Because each of the impedance of the sensor element, the resistance of the heater 16, and the integral power consumption of the heater 16 is information having a correlation with the temperature of the sensor element, when the impedance of the sensor element, the resistance of the heater 16, and the integral power consumption of the heater 16 are monitored, it can be determined with high precision whether the temperature of the sensor element reaches the upper limit temperature, or not.

In addition, in the above embodiment, the present disclosure is applied to the exhaust gas sensor 14 (air-fuel ratio sensor or oxygen sensor) upstream of the catalyst 13. However, without being limited to this configuration, the present disclosure may be applied to the exhaust gas sensor 15 (air-fuel ratio sensor or oxygen sensor) downstream of the catalyst 13.

Further, the present disclosure is not limited to the air-fuel ratio sensor or the oxygen sensor, but can be implemented by being applied to various exhaust gas sensors (for example, NOx sensor) having a heater for heating the sensor element.

The invention claimed is:

1. A heater control device for an exhaust gas sensor, comprising:

a heater that heats a sensor element of an exhaust gas sensor disposed in an exhaust gas passage of an internal combustion engine; and a controller, comprising a processor and storage for storing instructions, which is configured to:

execute a preheating control for controlling an energization of the heater to preheat the sensor element within a temperature range causing no element crack attributable to water, and during execution of the preheating control, the controller is configured to:

determine whether a temperature of the sensor element reaches an upper limit temperature;

set an energization duty of the heater to a preheating promotion energization duty until determining that the temperature of the sensor element reaches the upper limit temperature, determine whether an inside of an exhaust pipe is in a drying state; and set the energization duty to a temperature maintaining energization duty to maintain the temperature of the sensor element at the upper limit temperature after determining that the temperature of the sensor element reaches the upper limit temperature until determining that the inside of the exhaust pipe is in the drying state, wherein:

the temperature maintaining energization duty is constant, the preheating promotion energization duty is constant and is larger than the temperature maintaining energization duty, the energization duty is at a same constant value at the preheating promotion energization duty in the preheating control until the controller determines that the temperature of the sensor element reaches the upper limit temperature, and the energization duty is at a same constant value at the temperature maintaining energization duty in the preheating control after the controller determines that the temperature of the sensor element reaches the upper limit temperature until controller determines that the inside of the exhaust pipe is in the drying stat.

2. The heater control device for an exhaust gas sensor according to claim 1, wherein the controller is further configured to calculate the preheating promotion energization control value according to at least one of an operating condition of the internal combustion engine and an environmental condition.

3. The heater control device for an exhaust gas sensor according to claim 1, wherein the controller is further configured to determine whether the temperature of the sensor element reaches the upper limit temperature, or not, on the basis of at least one of an impedance of the sensor element, a resistance of the heater, and an integral power consumption of the heater.

4. The heater control device for an exhaust gas sensor according to claim 1, wherein:

the controller is further configured to provide, after the preheating control has elapsed, a temperature increase control for controlling the energization of the heater so as to raise the temperature of the sensor element; and in the temperature increase control, the energization duty of the heater is set to a temperature increase energization duty having a value that is larger than the preheating promotion energization control value and larger than the energization control value.

5. The heater control device for an exhaust gas sensor according to claim 4, wherein the controller is further configured to provide, after a determination that the sensor element has been activated, an impedance control for controlling the energization of the heater so as to maintain the sensor element in an active state;

in the impedance control, the energization duty of the heater is subjected to a feedback control so as to match an impedance of the sensor element with a target impedance.

6. A heater control device for an exhaust gas sensor, comprising:

a heater that heats a sensor element of an exhaust gas sensor disposed in an exhaust gas passage of an internal combustion engine; and a controller, comprising a processor and storage for storing instructions which upon execution by the processor enable the controller to at least provide:

a heater energization control portion that executes a preheating control for controlling an energization of the heater to preheat the sensor element within a temperature range causing no element crack attributable to water, and during execution of the preheating control, the controller is configured to:

determine whether a temperature of the sensor element reaches an upper limit temperature;

set an energization duty of the heater to a preheating promotion energization duty until determining that the temperature of the sensor element reaches the upper limit temperature, determine whether an inside of an exhaust pipe is in a drying state; and sets the energization duty to a temperature maintaining energization duty to maintain the temperature of the sensor element at the upper limit temperature after determining that the temperature of the sensor element reaches the upper limit temperature until determining that the inside of the exhaust pipe is in the drying state, wherein:

the temperature maintaining energization duty is constant, and the preheating promotion energization duty is constant and is larger than the temperature maintaining energization duty;

the controller further provides, after the preheating control has elapsed, a temperature increase control for controlling the energization of the heater so as to raise the temperature of the sensor element;

in the temperature increase control, the energization duty of the heater is set to a temperature increase energization duty having a value that is larger than the preheating promotion energization control value and larger than the energization control value;

the controller further provides, after a determination that the sensor element has been activated, an impedance control for controlling the energization of the heater so as to maintain the sensor element in an active state;

in the impedance control, the energization duty of the heater is subjected to a feedback control so as to match an impedance of the sensor element with a target impedance, the energization duty is at a same constant value at the preheating promotion energization duty in the preheating control until the controller determines that the temperature of the sensor element reaches the upper limit temperature, and the energization duty is at a same constant value at the temperature maintaining energization duty in the preheating control after the controller determines that the temperature of the sensor element reaches the upper limit temperature until controller determines that the inside of the exhaust pipe is in the drying state.

* * * * *